United States Patent [19]

Cerruti

[11] Patent Number: 4,901,065

[45] Date of Patent: Feb. 13, 1990

[54] APPARATUS FOR SELECTIVELY PRESENTING, PARTICULARLY IN MOTOR VEHICLES, THE SAME INFORMATION MESSAGE IN DIFFERENT LANGUAGES

[75] Inventor: Eraldo Cerruti, Turin, Italy

[73] Assignee: Fiat Auto S.p.A., Turin, Italy

[21] Appl. No.: 256,101

[22] Filed: Oct. 7, 1988

Related U.S. Application Data

[63] Continuation of Ser. No. 111,140, Oct. 19, 1987, abandoned, which is a continuation of Ser. No. 577,831, Feb. 7, 1984, abandoned.

[30] Foreign Application Priority Data

Feb. 14, 1983 [IT] Italy ..... 67162 A/83

[51] Int. Cl.[4] ..... G09G 3/04

[52] U.S. Cl. ..... 340/756; 340/762; 340/765

[58] Field of Search ..... 340/756, 762, 759, 774, 340/775, 790, 765, 763, 815.03, 815.04; 313/515, 516, 517, 518, 519

[56] References Cited

U.S. PATENT DOCUMENTS

| | | | |
|---|---|---|---|
| 3,323,121 | 5/1967 | Burton et al. | 340/806 X |
| 3,444,319 | 5/1969 | Artzt et al. | 340/756 X |
| 3,573,791 | 4/1971 | Hesse | 340/790 |
| 3,594,777 | 7/1971 | Blair | 340/806 |
| 4,109,245 | 8/1978 | Hedin | 340/808 X |
| 4,122,444 | 10/1978 | Kitajima | 340/760 |
| 4,237,459 | 12/1980 | Cordova | 340/756 |
| 4,260,987 | 4/1981 | Osman | 340/756 |
| 4,261,126 | 4/1981 | Bezjian | 340/756 X |
| 4,291,307 | 9/1981 | Peelle et al. | 340/756 |
| 4,323,893 | 4/1982 | Ypsilantis et al. | 340/756 |
| 4,361,828 | 11/1982 | Hose | 340/808 X |
| 4,368,464 | 1/1983 | Azzam | 340/756 |
| 4,394,651 | 7/1983 | Frankston et al. | 340/756 |
| 4,428,681 | 1/1984 | Kashio | 340/756 X |
| 4,458,243 | 7/1984 | Sado et al. | 340/756 |

FOREIGN PATENT DOCUMENTS 2071386 9/1981 United Kingdom .

*Primary Examiner*—Gerald Brigance
*Assistant Examiner*—M. Fatahiyar
*Attorney, Agent, or Firm*—Morgan & Finnegan

[57] ABSTRACT

A message is selectively presented in several different languages on an alpha-numeric visual display device. The display device has surface segments each of which can be selectively and individually switched, by connection to a power supply, between two operational states one of which corresponds to visual perceptibility of the segment itself. Selective interconnection of the segments and power supply is effected via connecting lines, the number of such lines being the same as the number of sub-sets of the complete set constituted by the languages in which the message is to be presented, whereby each of the lines corresponds uniquely to one of the sub-sets. Each of these lines is connected to all the segments that are only required to be switched to their states of perceptibility during the presentation of the message in each and every language contained in the corresponding sub-set. Selector means enable a language of message presentation to be selected, and serve to interconnect the power supply with all those, and only those, connecting lines which correspond to the sub-sets containing the selected language.

5 Claims, 7 Drawing Sheets

FIG. 6

Figure 1:
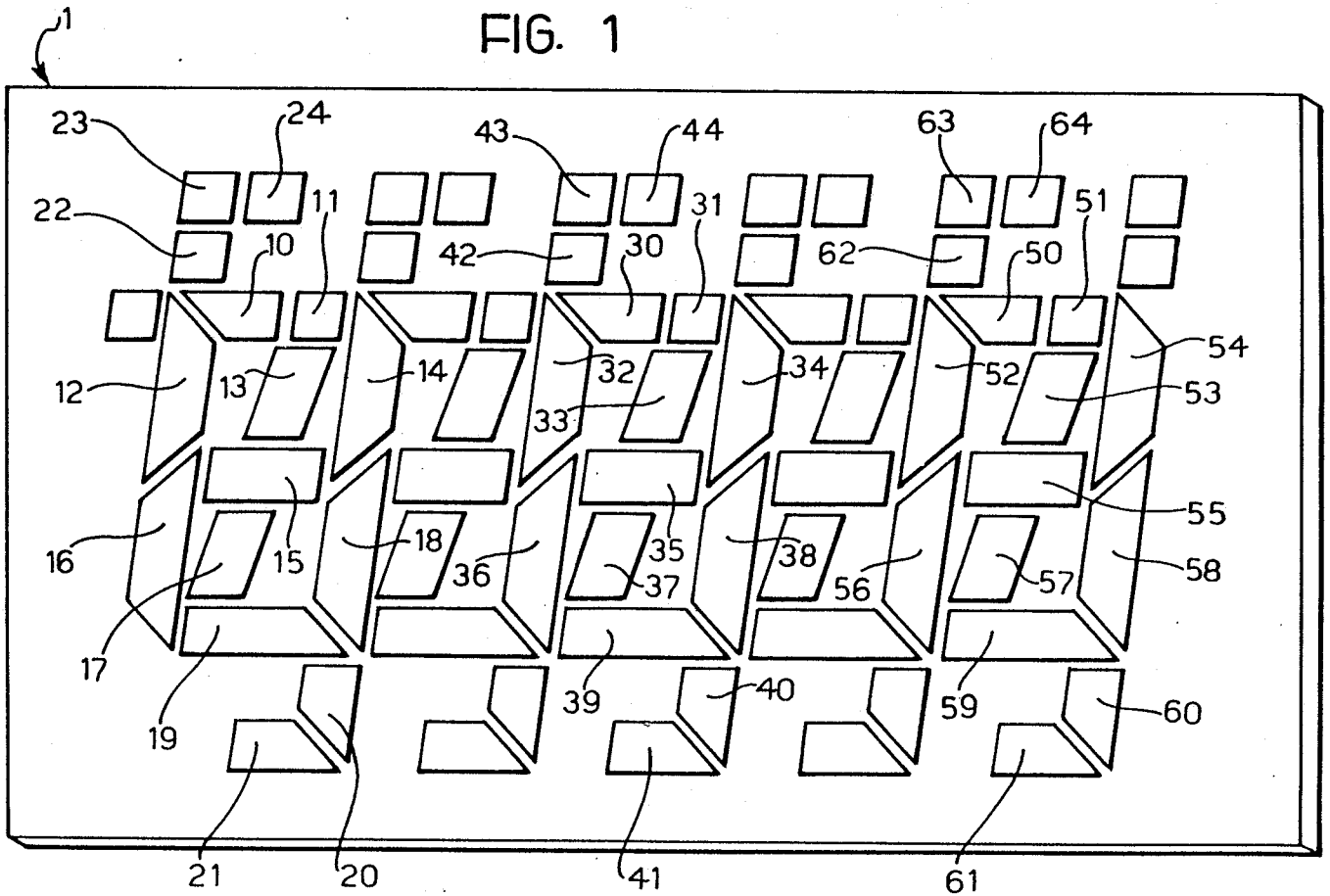

| LANGUAGE SUB SETS | 1ST CHARACTER | 2ND CHARACTER | 3RD CHARACTER |
|---|---|---|---|
| I+F+GB+D | | 39 | |
| I | | | |
| GB | | | 50,51,55,58,59 |
| F | 10, 11 | | |
| D | | | |
| I+GB | | | |
| I+F | | | 56, 63 |
| I+D | | | |
| GB+F | 12, 16, 19 | | |
| GB+D | 20, 21 | | |
| F+D | | | |
| I+GB+F | | 32 | 52 |
| I+GB+D | | 30, 31, 35 | |
| I+F+D | | 38 | |
| GB+F+D | 14, 18 | 34, 36 | |

APPARATUS FOR SELECTIVELY PRESENTING, PARTICULARLY IN MOTOR VEHICLES, THE SAME INFORMATION MESSAGE IN DIFFERENT LANGUAGES

This is a continuation of co-pending application Ser. No. 111,140, filed on Oct. 19, 1987 now abandoned, which a continuation of 577,831 filed on 2/7/84 now abandoned.

The present invention relates to the presentation of informative messages on a device for visually displaying alpha-numeric characters using surface segments each of which can be switched individually and selectively between two operational states one of which corresponds to visual perceptibility of the segment itself. Typical examples of such devices are light emitting diodes (L.E.D.), devices, vacuum fluorescent (V.F.) devices, and liquid crystal devices (L.C.D.).

The invention relates more particularly to the selective presentation of the same informative message in different languages and in particular, but not exclusively, to the presentation of this informative message in a motor vehicle.

The need to present informative messages in different languages in a motor vehicle is apparent more and more every day in view of the current tendency to increase the amount of information presented to the driver during use of the motor vehicle. Much of this information is complex and involved and thus cannot be expressed symbolically by means of ideographs. On the contrary it frequently takes on the character of verbal messages which, to be comprehensible to the greatest possible number of users of different nationalities, must be translated into different languages.

Devices referred to as "electronic translators" are known in the art, these devices being usually made in pocket-calculator form and allowing the same word or the same ideomatic phrase to be presented in two or more languages on a light emitting diode or liquid crystal display unit. Such devices normally include a miniaturised processing circuit with associated read-only memories in which the translated vocabulary is stored.

Devices similar to these translation devices could be used for the presentation of informative messages in several languages in motor vehicles. Their use is, however, expensive and could give rise to serious problems of operational reliability in view of the considerable mechanical and thermal stresses to which these devices would be subject in motor vehicles.

The invention overcomes these disadvantages by virtue of a method for selectively presenting the same informative message in different languages on an alphanumeric visual display device that uses surface segments each of which can be switched selectively between two operational states, one of which corresponds to visual perceptibility of the segment itself, characterised in that it includes the steps of:

providing a supply for causing switching of the said segments to their states of visual perceptibility, providing the same number of connecting lines as the number of sub-sets of the complete set formed by the different languages of message presentation, whereby each of the said lines is associated with a corresponding sub-set, connecting to each of the said lines all the segments that are only required to be switched to their states of visual perceptibility for the presentation of the message in each and every language in the corresponding sub-set, and providing selector means for enabling a language of message presentation to be selected and which are arranged to connect to the supply all those, and only those, connecting lines that correspond to the sub-sets including the selected language.

According to a further aspect of the present invention there is provided an apparatus for selectively presenting the same predetermined informative message in different languages on a visual display device having surface segments each of which can be switched individually and selectively between two states of operation, one of which corresponds to visual perceptibility of the segment itself, characterised in that it comprises:

a supply for causing switching of the said segments to their states of visual perceptibility, connecting lines equal in number to the number of sub-sets of the complete set formed by the different languages of message presentation; each of the lines being associated with one of the subsets and serving for the connection to the power supply of all the segments that are only required to be switched to their states of visual perceptibility for presentation of the message in each and every language in the associated sub-set, and selector means for enabling the selection of a language of message presentation and for connecting to the supply all those, and only those, connecting lines that correspond to the sub-sets including the selected language.

By virtue of this characteristic, the invention allows the economic and reliable presentation, particularly in a motor vehicle, of predetermined informative messages in a presentation language chosen by the user from a group made up of the major languages.

Figure 7:
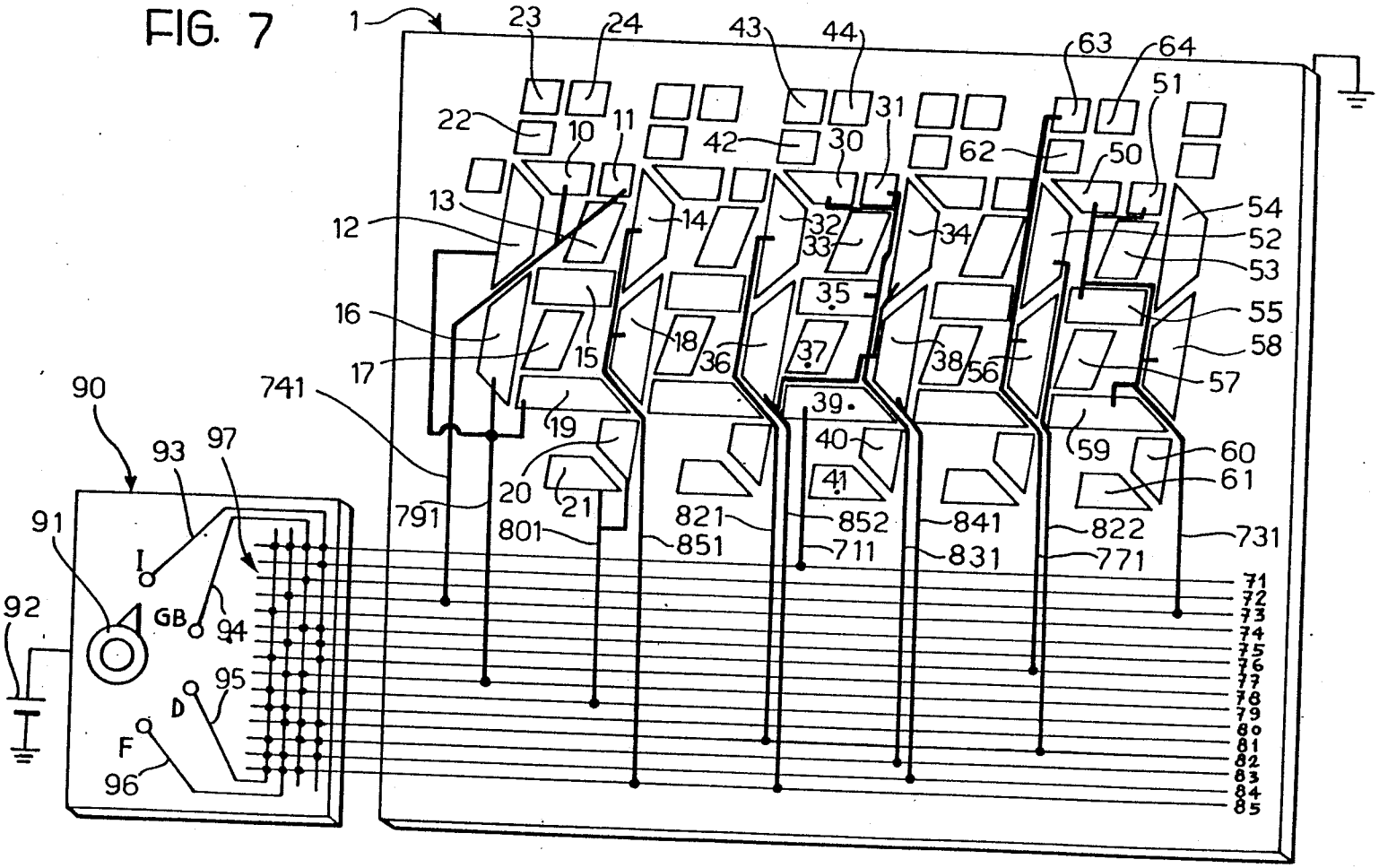
Figure 8:
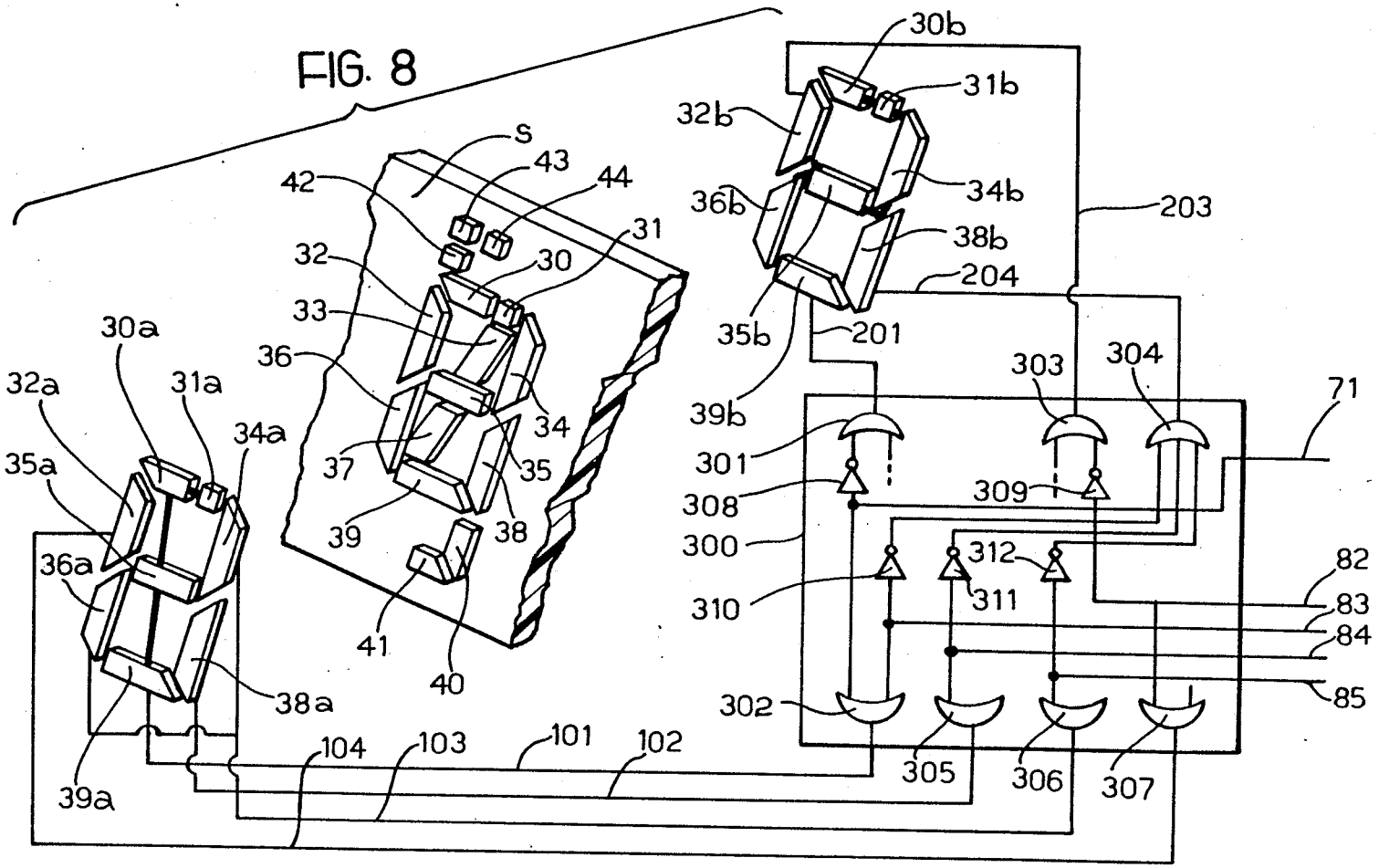
Figure 9:
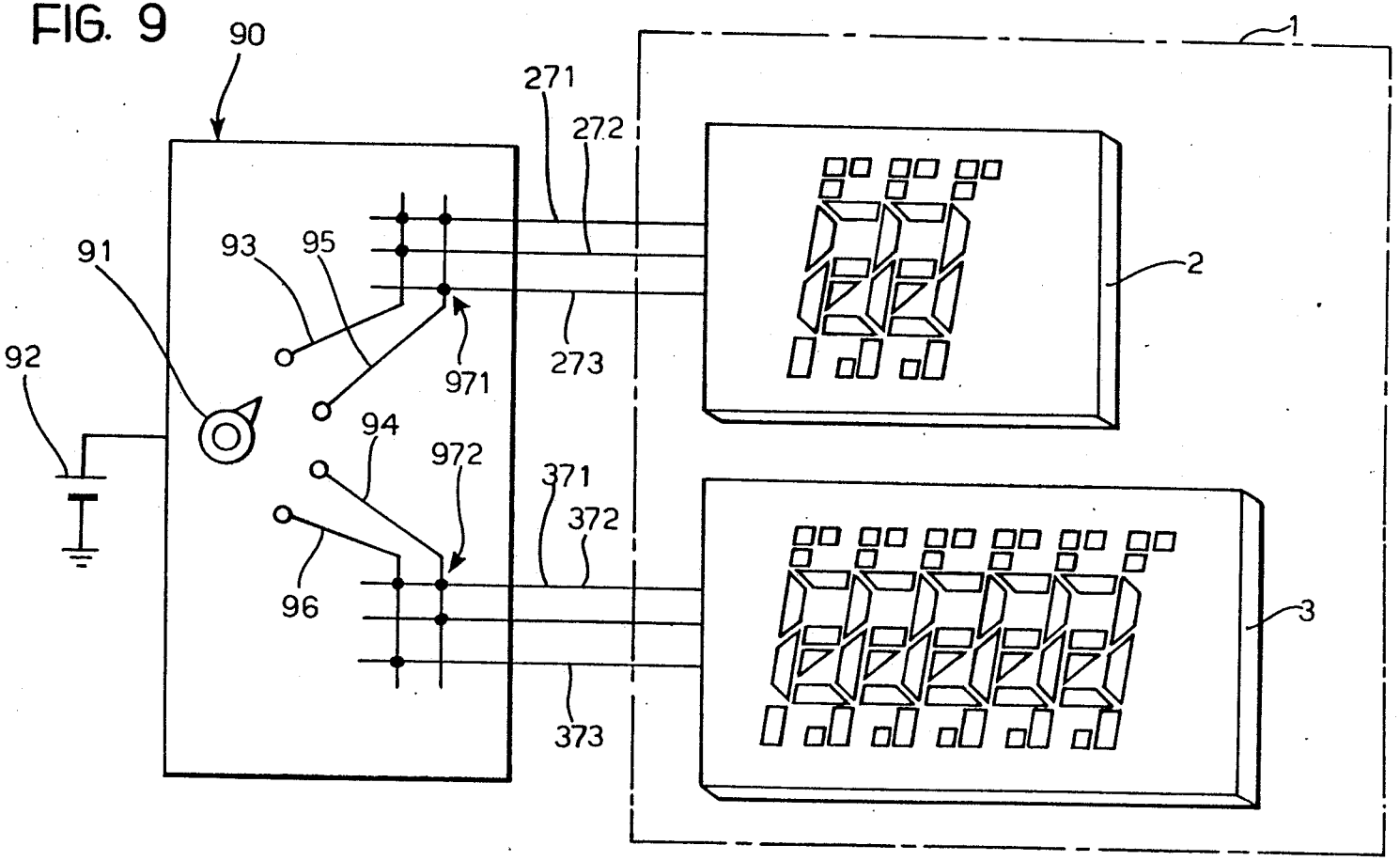
Figure 10:
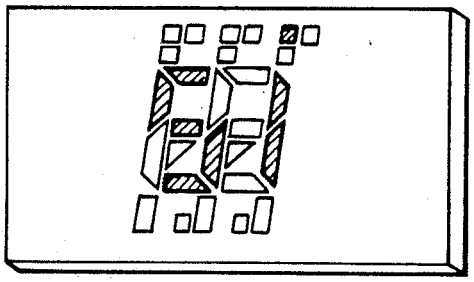
Figure 11:
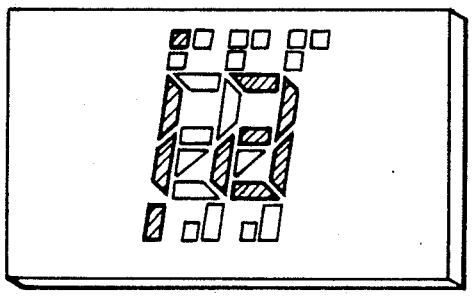
Figure 12:
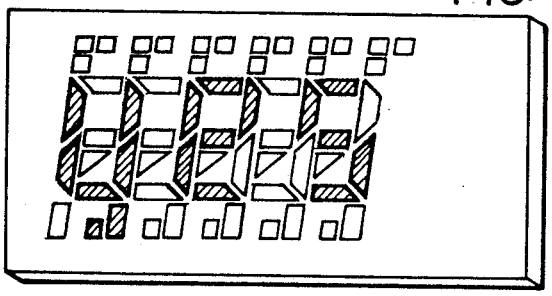
Figure 13:
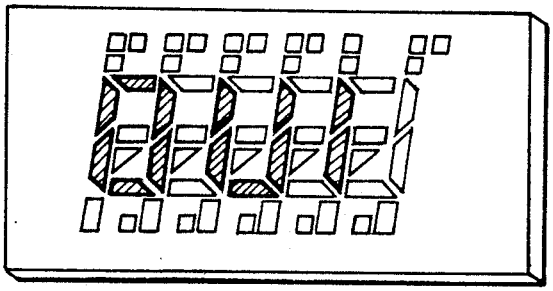

The invention will now be described, purely by way of non-limiting example with reference to the appended drawings, in which:

FIG. 1 is a schematic illustration of a device for visually displaying alpha-numeric characters, FIGS. 2 to 5 illustrate the presentation of the same informative message on the device of FIG. 1 in four different languages, FIG. 6 is a table illustrating the criteria which regulate the presentation of the informative message in the four languages on the device of FIG. 1, FIG. 7 illustrates apparatus according to the invention, FIG. 8 is an exploded perspective view relating to a variant of one of the devices of FIG. 7, FIG. 9 illustrates a further embodiment of the apparatus of FIG. 7, and FIGS. 10 to 13 illustrate the presentation of the same message by means of the apparatus of FIG. 10.

In FIG. 1 a device for visually displaying alphanumeric characters is generally indicated 1 and includes a screen on which there are a plurality of surface segments arranged in a periodic structure.

Each surface segment can be switched individually and selectively between two operational states one of which corresponds to visual perceptibility of the segment itself.

The device 1 may be made by any of the technologies currently used for the manufacture of visual display units such as, for example, light emitting diode technology (L.E.D.), vacuum fluorescent technology (V.F.) or liquid crystal technology (L.C.D.).

When light emitting diode (L.E.D.) or vacuum fluorescent (V.F.) technology is used, switching to a state of perceptibility is achieved by connecting each segment to a voltage source. This makes the whole surface of the segment become luminous and thus distinguishable from the dark background of the screen.

When liquid crystal technology is used, connection to a voltage supply causes a variation in the refractive index of the entire segment which takes on a clear colour clearly contrasting with the semi-opacity of the rest of the screen or vice versa.

The device illustrated in FIG. 1, in which the segments are arranged in identical adjacent groups forming a periodic structure, allows the visual display of all lower-case alphabet characters as well as all the Arabic numerals.

It should however be noted that the present invention does not relate exclusively to such a visual display device but can also be applied to any multi-segment visual display device.

In order to facilitate an understanding of the invention, some of the segments of the visual display device 1 have been numbered progressively with numbers between 10 and 24, between 30 and 44 and between 50 and 64.

In the embodiment of the invention illustrated, each group of segments indicated by a series adjacent numbers is intended to visually display an individual alphabet character in connection with the presentation of the same verbal message in four languages that is, in Italian (I), English (GB), French (F) and German (D).

Purely by way example, and so as not to make the present description over-involved the verbal message that will be considered is the elementary affirmative message, in respect of which it is desired to achieve the selective presentation of its four forms "si", "yes", "oui", and "ja", corresponding to the translation of this message into the four languages mentioned above.

FIGS. 2 to 5, in which the numerical references to the segments of FIG. 1 have been omitted for simplicity, each illustrates a possible presentation of this message on the visual display device 1.

A comparison of FIGS. 2 to 5, shows that the group of segments 10 to 24 (first character) is used for the presentation of the message in English, French and German. The group of segments 30 to 44 (second character) is used for the presentation of the message in all four languages considered.

The group of segments 50 to 64 (third character) is used for the presentation of the message in Italian, English and French, but not for the presentation of the message in German.

If FIGS. 2 to 5 are analysed further it can be seen that the segments 10 and 11 are used solely during presentation of the French message while the segments 12, 16 and 19 are used during presentation of the message both in English, and in French. The segments 20 and 21 are used during presentation of the message in English and in German, while the segments 14 and 18 are used for presentation of the message in English, in French and in German.

In an entirely analogous manner it can be seen that the segment 39 of the second character is used during presentation of the message in all four languages. The segment 32 is however used during presentation of the message in Italian, in English and in French but not during the presentation in German. The segments 30, 31 and 35 are used during presentation of the message in Italian, English and German while the segment 38 is used during presentation of the message in Italian, French and German. The segments 34 and 36 are used during the presentation of the message in English, French and German, but not during presentation of the message in Italian.

Finally, with reference to the third character, it is possible to see that the segments 50, 51, 55, 58, 59 are used solely during presentation of the message in English, while the segments 56 and 63 are used during presentation of the message both in Italian and in French. The segment 52 is used for the presentation of the message in Italian, in English and in French.

The results of the analysis of FIGS. 2 to 5 are summarised in the table of FIG. 6.

In the left hand column of this table are listed all the sub-sets of the complete set formed by the four languages (I, F, GB, D) in which it is wished to be able to present the message selectively. There are fifteen of these sub-sets and they express all the possible combinations of the four languages indicated above. It should be noted that, in the present description and in the following claims, the term "sub-sets" of the complete set formed by the "languages of presentation" extends to all the sub-sets within which there is at least one languages; the empty sub-set 0, which the theory of sets normally includes among the sub-sets of any complete set is not considered here since it has no relevance in connection with the functioning of the apparatus of the invention, corresponding at most to the deactivation of the apparatus itself.

In FIG. 7 references 71 to 85 indicate fifteen conductive strips applied to one of the faces of the screen of the FIG. 1 device.

It should be noted, as will be obvious to the expert in the art, that the metallised strips 71 to 85 are illustrated on an enlarged scale compared with the rest of the device 1 so as to facilitate the understanding of the electrical connections used in the apparatus of the invention.

The strips 71 to 85 may be formed on one of the faces of the screen of the device 1 by the technology normally used for the manufacture of printed circuits, the number of strips being equal to the number of sub-sets of the languages of presentation listed in the left hand column of FIG. 6.

Each conductive strip 71 to 85 is thus uniquely indicative of one of these sub-sets.

Associated with each of the strips 71 to 85 that extends on the screen of the device 1 parallel to the alignment direction of the segment groups for presenting individual characters of the message, is a connecting track (also obtained by the technology normally used for printed circuits and integrated circuits). Each of these tracks connects one of the strips 71 to 85 to all the segments that are only required to be switched to their states of perceptibility during the presentation of the informative message in each and every language included in the sub-set of which this strip is indicative.

Thus, from the strip 74 which is indicative of the sub-set formed by the single language French, there extends a connecting track indicated 741 which connects the strip 74 to the segments 10 and 11.

The line 79 which is indicative of the sub-set constituted by the languages English and French, is connected by means of a connecting track 791 to the segments 12, 16 and 19. The line 80, indicative of the sub-set formed by the languages English and German is connected through a connecting track 801 to the segments 20, 21. Finally, the line 85, indicative of the sub-set formed by the language English, French and German is connected through a connecting track 851 to the segments 14 and 18.

With reference to the segments 30 to 44 for visually displaying the second character of the message, the strip 71, indicative of the sub-set formed by all four languages of presentation, is connected through a track 711 to the segment 39. The strip 82, indicative of the sub-set formed by Italian, English and French, is connected through a track 821 to the segment 32. A track 831 connects the segments 30, 31 and 35 to the strip 83 indicative of the sub-set formed by Italian, English and German. A track 841 connects the segment 38 to the strip 84, indicative of the sub-set formed by Italian, French and German. The strip 85, as indicated above, is indicative of the sub-set formed by English, French and German and is connected through a track 852 to the segments 34 and 36.

Finally, with reference to the segments 50 to 64, the segments 50, 51, 55, 58 and 59 are connected through a single track 731 to the strip 73 indicative of the sub-set formed by the single language English.

A further track, indicated 771 connects the segments 56 and 63 with the strip 77 indicative of the subset formed by the language Italian and by the language French. Finally, a track 822 connects the segment 52 with the strip 82 which, as indicated above is indicative of the sub-set formed by Italian, English and French.

The strips 71 to 85 and the connecting tracks which terminate thereat, are intended to enable the selective switching of the segments 10 to 24, 20 to 44 and 50 to 64 to their states of visual perceptibility.

When the visual display device 1 is formed using light emitting diode technology (L.E.D.), the switching of the segments to their states of perceptibility corresponds to the application of a bias voltage across the semi-conductor junctions associates with the segments themselves.

It is apparent that the above-described arrangement for connecting the strips 71 to 85 to their respective segments is given purely by way of example.

In FIG. 7 a selector device generally indicated 90 includes a rotatable control member 91 which can be disposed in four positions each of which corresponds to the selection of a language in which the message is to be presented.

When the apparatus of the invention is used in a motor vehicle to achieve the visual display of messages indicative of the conditions of use of the motor vehicle, the rotatable member 91 could be operated by a knob located on the dashboard in reach of the driver. Alternatively the rotatable member 91 could be located in a position not directly accessible to the driver or to the purchaser of the vehicle so that the selection of the language of presentation can only be effected at sales outlets and service centres.

In each of its positions, the rotatable member 91 serves to connect a voltage source 92 to one of the four connection lines indicated 93, 94, 95 and 96 respectively, each of which corresponds to one of the four languages of message presentation.

Each line 93 to 96 terminates at an interconnection matrix generally indicated 97 to which the conductive strips 71 to 85 are connected.

Within the connection matrix 97, each line 93 to 96 is connected to all and only those strips 71 to 85 indicative of sub-sets including the respective language of presentation.

Thus the line 93 indicative of the selection of the Italian language is connected to the strips 71, 72, 76, 77, 78, 82, 83 and 84.

The line 94, indicative of the selection of the English language is connected, as well as to the strip 71, also to the strips 73, 76, 79, 80, 82, 83 and 85.

The line 95, indicative of the selection of the language German is connected to the strips 71, 75, 78, 80, 81, 83, 84 and 85.

Finally the line 96, indicative of the selection of the language French, is connected to the strips 71, 74, 77, 79, 81, 82, 84 and 85.

Figure 2:
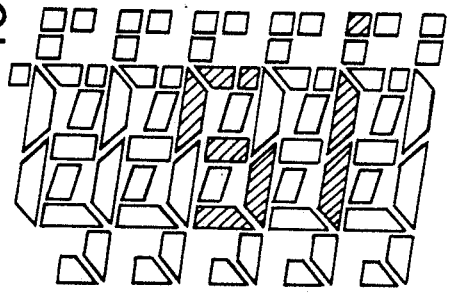
Figure 3:
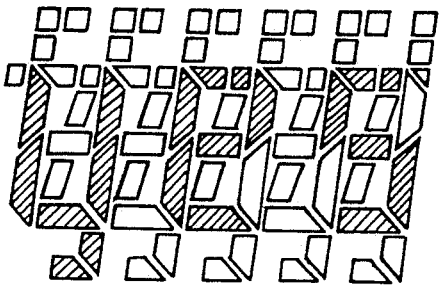

The arrangement described is such that, when the selector 90 is set for presentation of the message in the Italian language and the source 92 is activated, the segments 30, 31, 32, 35, 38, 39, 52, 56, 63, are illuminated resulting in presentation of the message "si" in accordance with configuration illustrated in FIG. 2.

Figure 4:
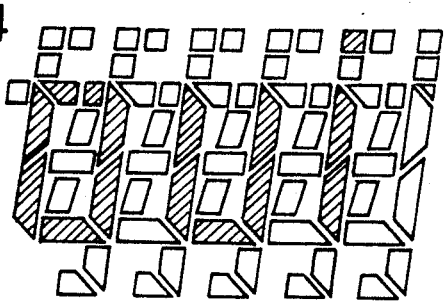
Figure 5:
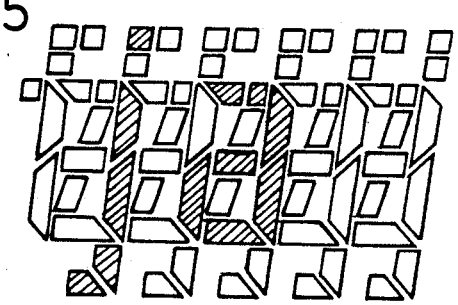

In a substantially similar manner, when the selector device 90 is set for presentation of the message in the French language and the voltage source 92 is turned on, the segments 10, 11, 12, 14, 16, 18, 19, 32, 34, 36, 38, 39, 52, 56 and 63 become luminous simultaneously resulting in the presentation of the message "oui" in accordance with configuration illustrated in FIG. 4.

In an entirely equivalent manner the selector device 90 may be set to cause presentation of the message "yes" and "ja" in The English language and in the German language.

The invention is based upon the observation that the order of complexity of the problem inherent in the presentation of the same message in different languages is defined solely by the number of the languages from which it is wished to choose the language of presentation. Fifteen connecting lines (conductive strips) thus suffice to allow the presentation of any message in four different languages. The factor that changes on variation of the message and its length, is the connection arrangement of these connecting lines to the segments of the visual display device. This connection arrangement is defined when deciding on the message it is desired to present and may easily by reproduced during the production phase of each visual display device 1.

For example, when it is wished to present a series of different messages in the same language, possibly simultaneously, on the dashboard of a motor vehicle, it will suffice to provide a connection arrangement, formed according to the invention, on each visual display device intended to present one of these messages. The segments of each visual display device will be externally operable by controlling the same predetermined number of connection lines for each visual display device, this number being equal to fifteen when it is wished to choose the language of presentation from four languages.

Corresponding connection lines of the various visual display devices can be connected together and connected to the selector device 90.

From what has been described, it is seen that the invention allows the problem of the presentation of informative messages in a language chosen from several languages in dependence on the requirement of the user to be solved in a particularly economical, reliable and efficient manner.

FIG. 8 illustrates, with reference to the segments 30 to 44 for presenting the second character of the message indicated in FIGS. 2 to 5, a possible variant of the invention.

In FIG. 8 the segments 30 to 44 have been illustrated in the form of spatial domains located within a display substrate S constituted by a plate member having two opposing parallel planes.

The conductive elements such as metallisations applied to the two faces of the substrate S have been indicated by numerals corresponding to the numerals indicative of the segments with the addition of the letter suffixes a and b.

The conductive elements of each corresponding pair of elements, for example the elements 36*a* and 36*b*, together enclose a respective segment, for example the segment 36.

The conductive elements located on opposite faces in the substrate S are intended to apply a polarisation voltage to the two opposite faces of the segment enclosed therebetween to achieve the switching of the segment itself to a state of visual perceptibility.

A typical example of this arrangement is a liquid crystal (L.C.D.) display device in which each segment assumes a uniformly clear colour contrasting with the overall opaque appearance of the substrate S as a result of a voltage applied through the screen S itself by means of two electrodes located on opposite faces of the screen.

The embodiment illustrated in FIG. 8 is intended to produce simplification of the connection arrangement of the segments of the device 1 with the connection lines 71 to 85. In this embodiment, four connection lines extend across each face of the screen S.The connection lines on one face are indicated by the numbers 101, 102, 103 and 104.

The lines on the other face are indicated by the numerals 201, 203 and 204.

The lines 101 to 104 and 201 to 204 are intended to form a matrix-like arrangement connecting the segments of the device 1 to the connecting lines 71 to 85.

This connection arrangement is achieved through a logic network generally indicated 300.

By means of the logic network 300, each connecting line 71 to 85 is connected to a pair of the lines 101 to 104, 201 to 204 so that, on connection of one of the lines 71 to 85 to the source 92, a voltage difference is correspondingly applied across the conductive elements associated with the segments of the device 1 connected to this connecting line.

In FIG. 8, reference 301 to 307 indicate respective logic OR gates. Reference 308 to 312 however indicate respective inverter stages.

The arrangement described is such that the switching of the segment 39 to a state of visual perceptibility is controlled from the line 71 through the lines 101 and 201 which terminate at the conductive elements 39*a* and 39*b* respectively. When the voltage signal produced by the source 92 is applied to the line 71, then by virtue of the action of the inverter 308, a voltage difference is established between the elements 39*a* and 39*b* which causes switching of the segment 39 lying therebetween to its state of perceptibility.

In an entirely analogous manner, the line 82 allows the segment 32 to be switched to its state of visual perceptibility through the lines 104 and 203.

The switching of the segments 30, 31, 34, 35, 36 and 38 is controlled by the lines 83, 84 and 85 through the line 204 common to all the segments and through the lines 101, 102 and 103.

The conductive elements 30*b*, 31*b*, 34*b*, 35*b*, 36*b* and 38*b*, all connected to the line 204 may be connected directly together with a considerable simplification in the connection arrangement on one of the faces of the screen S.

On the other face of the screen S there is a common connection (line 103) between the conductive elements 34*a* and 36*a*. Another common connection (line 101) exists between the segments 30*a*, 31*a* and 35*a*. The same line 101, as indicated above, controls the switching of the segment 39; the conductive element 39*a* can thus be connected to the conductive elements 30*a*, 31*a* and 35*a*.

The application of the voltage signal produced by the source 92 to the lines 83, 84 and 85, causes, in a manner entirely analogous to that described above with reference to the lines 71 and 82, the activation of the corresponding segments 30, 31, 35, of the segment 38, and of the segments 34 and 36.

The presence of common connections between the conductive elements on one face of the screen S however allows a considerable simplification of the connection arrangement of the segments to the lines 71 to 85.

In the variant illustrated in FIG. 9, the device 1 includes two distinct units indicated 2 and 3, each of which has a screen with a plurality of surface segments arranged in identical groups and defining a periodic structure.

Purely by way of example, there is illustrated here the use of groups of segments (for which the reference numerals have been omitted) having a configuration and a distribution different from that of the segments present on the screen of the device 1 of FIG. 1.

The configuration and the distribution of the segments of the units 2 and 3, which may also constitute lines located one above another or even distinct fields of a single visual display screen, are illustrated in greater detail in Italian Utility Model application No. 52941-B/83 filed by the Applicant.

In the variant of FIG. 9, the most important difference from the apparatus of FIG. 7 results from the fact that the unit 2 is used for the presentation of the informative message in Italian and in German and the unit 3 is used for English and French. FIGS. 10 to 13 show schematically the presentation of the message on the units 2 and 3.

This results in a considerable simplification of the connection arrangements. In the case of the embodiment of FIG. 7, fifteen supply lines (strips) (71 to 85) converge on the visual display device 1 each of which corresponds to a sub-set of the complete set of languages (Italian, English, French, German) for message presentation on the device 1.

In the embodiment of FIG. 9, each of the units 2 and 3 is used for the presentation of the message in only two languages. The number of supply lines converging on each of these units is thus reduced to three.

The supply of the unit 2 (visual display in Italian and German) may in fact be achieved by means of a first strip 271 (to which the segments which are activated both during the presentation of the message in Italian and during the presentation of the message in German are connected), of a second strip 272 (to which the segments used only during presentation in Italian are connected) and a third strip 274 (to which the segments used only during presentation in German are connected).

In an entirely analogous manner three strips indicated 371, 372 and 373 are used in order to supply the unit 3

(visual display in English and French), these strips being connected respectively to the segments used during presentation of the message in English and during presentation of the message in French, to be segments used during presentation solely in English, and to the segments used during presentation solely in French.

Clearly the connection of the lines 271, 272, 273 and 371, 372, 373 to the segments of the respective units 2 and 3 may be achieved both in the manner described with reference to FIG. 7 and according to the variant illustrated in FIG. 8 or in an equivalent manner, for example that illustrated in the Utility Model Application mentioned above.

The circuitry simplification described above derives from the observation of the fact that the sum of the number of sub-sets (three) of each of the two sub-sets formed by the languages (two) in which the message is presented on each of the units 2, 3 is less than the number of sub-sets (fifteen) of the complete set formed by all four languages of message presentation.

The method of dividing the original complete set of four languages of presentation described above into two sub-sets can obviously be generalised to any different number of languages and to any different scheme of division.

The simplification of the connection arrangement of the device 1 results in a corresponding simplification of the connection matrix 97 of the selector device 90 of FIG. 7. In each embodiment of FIG. 9, the selector device 90 includes two connection matrices 971 and 972, the complexity of which is cumulatively less than the complexity of the matrix 97 of FIG. 7.

A further circuit simplification may be achieved by modifying the rotatable element 91 and the lines 93 to 96 so as to obtain presentation of the message in two languages simultaneously, for example, in Italian on the unit 2 and in English on the unit 3 with the rotatable element 91 in one position, and in German on the unit 2 and in French on the unit 3 with the rotatable element 91 in another position.

In the embodiment illustrated, which relates to the presentation of a basic affirmative message, a further simplification is introduced by observing that this message is composed of two characters ("si" "ja") in Italian and German and of three characters ("yes", "oui") in English and French. The use of the unit 2 for the presentation in Italian and German has thus permitted a reduction in the number of segments present on this unit.

I claim:

1. An apparatus for selectively displaying a predetermined message in a set of different languages, said apparatus comprising:

a visual display device having surface segments each of which can be switched individually and selectively between two states of operation, one of which corresponds to visual perceptibility of the segment itself, a power supply for causing switching of said segments to their states of visual perceptibility, connecting lines equal in number to the number of possible non-null sub-sets of said set, each of said connecting lines being associated with a different one of said sub-sets and connecting said power supply to all of said segments required to be switched to their states of visual perceptibility, for displaying said message, which are common in every language in the associated sub-set, and selector means for enabling the selection of a selected language from said set of different languages, and for connecting said power supply to the connecting lines which correspond to the sub-sets which include the selected language.

2. An apparatus according to claim 1, wherein:

(a) said visual display device includes a plurality of distinct display elements, which are arranged to display said message in a respective set of different languages, and (b) for each of said distinct display elements, the same number of said connecting lines are provided as the number of possible non-null sub-sets of said respective sets of languages.

3. An apparatus according to claim 2, wherein said selector means comprises means for simultaneously connecting said power supply to the connecting lines associated with a plurality of said distinct display elements to simultaneously display the message in a plurality of different languages so that each of the distinct display elements displays the message in one of the languages selected from the set of all message languages.

4. An apparatus according to claim 1, wherein said segments of said display device are arranged in groups aligned with each other, each group serving to display an individual character of the message, said connecting lines comprising conductive strips which extend in a direction parallel to said groups of segments and connecting tracks connecting said conductive strips to the corresponding segments.

5. An apparatus according to claim 1, wherein said display device includes a flat visual display screen comprising said surface segments, and wherein said surface segments can be individually switched to their states of visual perceptibility by application of a voltage between two faces of the screen, each of said connecting lines including two branches extending on opposite faces of said screen and facing one another in correspondence with the segments connected to the respective line, and at least one of said branches includes a part common to a plurality of said connecting lines.

* * * * *